US011753210B1

(12) United States Patent
Spieler, IV et al.

(10) Patent No.: US 11,753,210 B1
(45) Date of Patent: Sep. 12, 2023

(54) BUCKET BAND DEVICES AND METHODS

(71) Applicant: TreFoil Industries, Inc., Hoover, AL (US)

(72) Inventors: August Joseph Spieler, IV, Hoover, AL (US); Robert Wayne Clay, Huntsville, AL (US)

( * ) Notice: Subject to any disclaimer, the term of this patent is extended or adjusted under 35 U.S.C. 154(b) by 0 days.

(21) Appl. No.: 17/686,888

(22) Filed: Mar. 4, 2022

(51) Int. Cl.
*B65D 25/20* (2006.01)
*B25H 3/00* (2006.01)
*B44D 3/12* (2006.01)

(52) U.S. Cl.
CPC ..... *B65D 25/20* (2013.01); *B25H 3/00* (2013.01); *B44D 3/125* (2013.01)

(58) Field of Classification Search
CPC ..... B65D 25/20; B25H 3/00; B44D 3/125
USPC ..... 206/350, 372, 373
See application file for complete search history.

(56) References Cited

U.S. PATENT DOCUMENTS 4,362,243 A * 12/1982 Deyesso ..... B25H 3/02 206/562
4,765,472 A * 8/1988 Dent ..... A47J 47/18 206/373
4,925,026 A * 5/1990 McKay ..... B25H 3/02 206/372
4,993,551 A * 2/1991 Lindsay ..... B25H 3/00 383/7
5,174,447 A * 12/1992 Fleming ..... B25H 3/00 220/500
5,186,329 A * 2/1993 Fogelberg ..... B65D 25/04 220/555
5,350,065 A * 9/1994 Darrey ..... B25H 3/00 220/735
5,386,922 A * 2/1995 Jordan ..... B65D 77/0486 220/4.27
5,429,265 A * 7/1995 Maire ..... B25H 3/00 206/372
5,547,098 A * 8/1996 Jordan ..... B25H 3/06 220/528
5,669,498 A * 9/1997 Fierek ..... B25H 3/06 206/509
5,833,095 A * 11/1998 Russell ..... A45F 5/02 224/684
6,059,109 A * 5/2000 Stein ..... B65D 1/36 206/506
6,189,697 B1 * 2/2001 Davis ..... A45C 11/008 206/581
6,254,055 B1 * 7/2001 Lamberson, Jr. ..... A01K 97/10 206/315.11
7,273,148 B2 * 9/2007 Perry ..... B25H 3/00 206/214
7,431,056 B1 * 10/2008 Smith ..... F16N 33/00 206/349
8,127,965 B1 * 3/2012 Miller ..... B25H 3/04 220/528
9,763,510 B1 * 9/2017 Miner ..... A45F 5/02
2002/0088729 A1 * 7/2002 Urbanski ..... B44D 3/125 220/505

(Continued)

*Primary Examiner* — Jacob K Ackun
(74) *Attorney, Agent, or Firm* — DENNEN IP LAW, LLC

(57) ABSTRACT

The present disclosure is a device for carrying tools and sundries that has a bucket with an outside surface and an inside surface. Further, the device has at least one metal band coupled around the outside surface of the bucket and at least one magnet coupled to the metal band and configured for securing tools.

18 Claims, 4 Drawing Sheets

(56) References Cited

U.S. PATENT DOCUMENTS

| | | | | |
|---|---|---|---|---|
| 2003/0230606 | A1* | 12/2003 | Devinie | A45F 5/00 224/183 |
| 2008/0302689 | A1* | 12/2008 | Frakes | B25H 3/02 206/373 |
| 2009/0008280 | A1* | 1/2009 | Nilferli | B25H 3/04 206/373 |
| 2009/0283428 | A1* | 11/2009 | Adamany | B25B 27/0071 206/372 |
| 2009/0301912 | A1* | 12/2009 | Cornell | B65D 25/34 220/735 |
| 2011/0180437 | A1* | 7/2011 | Alt | B25H 3/02 206/372 |
| 2016/0167219 | A1* | 6/2016 | Cho | A45F 5/02 224/666 |

* cited by examiner

BUCKET BAND DEVICES AND METHODS

BACKGROUND

Construction workers often use buckets on a job site. For example, construction workers use five (5) gallon or seven (7) gallon buckets to carry the construction worker's tools. The tools may include paint brushes, pliers, hammers, wrenches, saws, screwdrivers, chisels, utility knives, and the like. The construction worker carries the tools in the receptacle of the bucket.

It is often difficult for the construction worker to locate a tool in the receptacle. The construction worker may at certain times have to dump the tools out to find the tool the construction worker is looking for.

DETAILED DESCRIPTION OF THE DRAWINGS

The present disclosure can be better understood with reference to the following drawings. The elements in these drawings are not necessarily drawn to scale but are included to clearly illustrate the principles pertaining to this disclosure. Furthermore, like reference numerals designate corresponding parts throughout the views.

DETAILED DESCRIPTION

Figure 1:
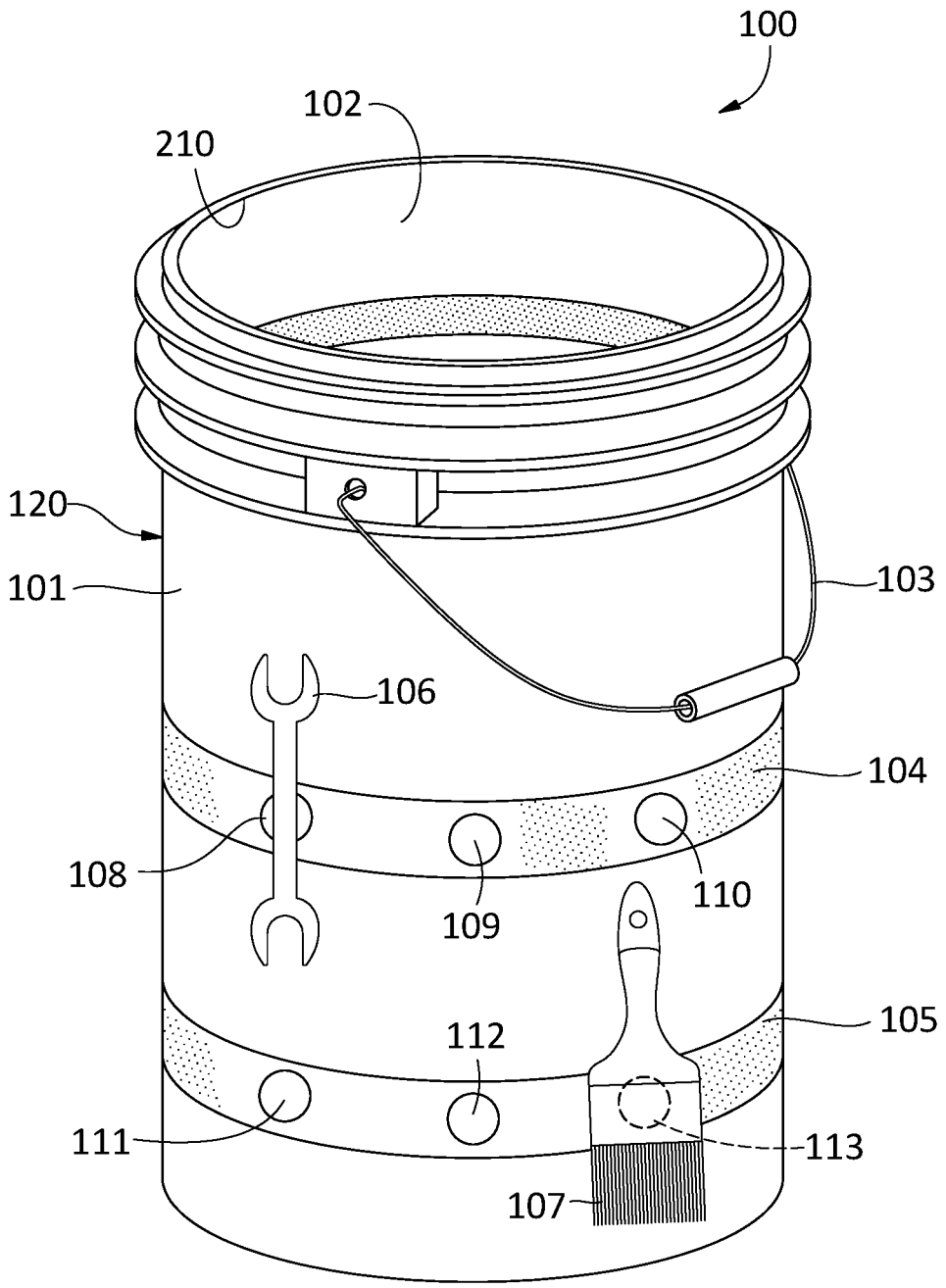
FIG. 1 is a front perspective view of an exemplary bucket in accordance with an embodiment of the present disclosure.

The present disclosure describes a bucket, e.g., a five (5) gallon or seven (7) gallon bucket, which is used in everyday household chores and on construction job sites. Note that five (5) gallon and seven (7) gallon buckets are merely exemplary. The bucket can be other sizes in other embodiments. The exemplary bucket comprises a cylindrical receptacle, a lid, and a handle. In one embodiment, the bucket may comprise only the receptacle and the handle.

The exemplary cylindrical receptacle comprises at least one outside circular metal band coupled to the outside surface of the receptacle. The at least one outside circular metal band laterally circles the outside surface of the cylindrical receptacle.

The at least one outside metal band may be coupled to the outside surface of the cylindrical receptacle via epoxy. The outside metal band may be coupled to the outside surface of the cylindrical receptacle in other ways in other embodiments. In another embodiment, there may be more bands coupled to the outside surface of the receptacle, e.g., two bands or three bands.

One or more magnets are magnetically coupled to the circumference of the at least one outside metal band. When there is a plurality of magnets coupled to the outside band, the magnets may be spaced apart along the outside metal band. In one embodiment, the magnets coupled to the outside metal band are circular. The magnets can be other shapes in other embodiments.

In use, metal tools or tools made partially of metal (e.g., a paint brush) couple to the magnets. Thus, the tools are coupled to the outside band(s) coupled to the outside surface of the receptacle. When coupled to the outside band(s), a construction worker can easily find a tool that is needed for a job. Furthermore, the construction worker can easily transport the tools coupled to the bands using the handle.

In one embodiment, the cylindrical receptacle has at least one circular metal band coupled to the receptacle's inside surface. The at least one inside circular metal band laterally circles the inside surface of the cylindrical receptacle.

The at least one inside metal band may be coupled to the inside surface of the receptacle via epoxy. The inside metal band may be coupled to the inside surface of the receptacle in other ways in other embodiments. Note that in other embodiments there may be more inside bands coupled to the inside surface of the receptacle, e.g., two bands or three bands.

One or more magnets are magnetically coupled to the circumference of the at least one inside metal band. When there is a plurality of magnets coupled to the inside metal band, the magnets may be spaced apart along the inside metal band. In one embodiment, the magnets coupled to the inside metal band are circular. The magnets can be other shapes in other embodiments.

In use, metal tools or tools made partially of metal (e.g., a paint brush) couple to the magnets on the circular inside metal band. Tools are coupled to the circular inside metal band(s), which are coupled to the inside surface of the receptacle. When coupled to the circular inside metal band(s), a construction worker can easily find a tool that is needed for a job. Furthermore, the construction worker can easily transport the tools coupled to the bands using the handle.

In one embodiment, the bucket comprises a basin that is coupled to an inside bottom of the receptacle. The basin may be coupled to the inside bottom of the receptacle via epoxy. Note that the basin may be coupled to the inside bottom of the receptacle in other ways in other embodiments. The basin that is coupled to the inside bottom of the receptacle may be magnetic. In this regard, metal objects like nails or screws, for example, may be placed and retained by the magnetic basin.

In one embodiment, the bucket has a lid that couples to the receptacle opening. For example, the lid may screw onto the receptacle. The screw lid comprises one or more indentations. Magnetized material may line the one or more indentations. Thus, metallic screws, nails, or other metal implements may be dropped onto the lid, and the lid magnetically retains the metallic screws, nails, or other metal implements in the indentations until they are needed.

FIG. 1 is a top perspective view of a bucket 100 in accordance with an embodiment of the present disclosure. Note that the bucket 100 may comprise a lid; however, the lid is not shown in this view. The bucket comprises a cylindrical receptacle 120 having an opening 210 in which objects may be placed. Further, the bucket 100 comprises a handle 103 so that the objects in the receptacle 120 may be transported in the receptacle 120. The receptacle 120 comprises an outside surface 101 and an inside surface 102.

The cylindrical receptacle 120 comprises at least one circular metal band 104 that laterally wraps around the circumference of the cylindrical receptacle 120. Note that in one embodiment, the receptacle 120 comprises a second circular metal band 105 below the circular band 104, as described above.

In one embodiment, the bands 104, 105 are retrofitted to couple to the outside surface 101 of the receptacle 120. In another embodiment, the bands may be affixed to the receptacle 120 via an epoxy. The bands 104, 105 may be affixed to the bucket in other ways in another embodiments.

One or more magnets 108-110 are magnetically coupled to the circumference of the at least one outside metal band 104. When there is a plurality of magnets 108-110 coupled to the outside metal band 104, the magnets 108-110 may be spaced apart along the outside metal band 104. In one embodiment, the magnets 108-110 coupled to the outside metal band 104 are circular. However, the magnets 108-110 can be other shapes in other embodiments.

One or more magnets 111-113 are magnetically coupled to the circumference of the outside metal band 105. When there is a plurality of magnets 111-113 coupled to the outside metal band 105, the magnets 111-113 may be spaced apart along the outside metal band 105. In one embodiment, the magnets 111-113 coupled to the outside metal band 105 are circular. However, the magnets 111-113 can be other shapes in other embodiments.

Tools, for example a wrench 106 and a paint brush 107, are magnetically coupled to the magnets 108 and 113, respectively. Because the tools 106 and 107 are magnetically secured to the receptacle 120, a user of the bucket 100 can transport the tools 106 and 107 when carrying the bucket 100 via the handle 103. In this regard, the wrench 106 and paint brush 113 couple to the magnets 108 and 113, respectively, and will not be lost in transport. Notably, the user can carry the bucket 100 with the handle 103 with the tools coupled thereto without risk of losing his/her tools.

Figure 2:
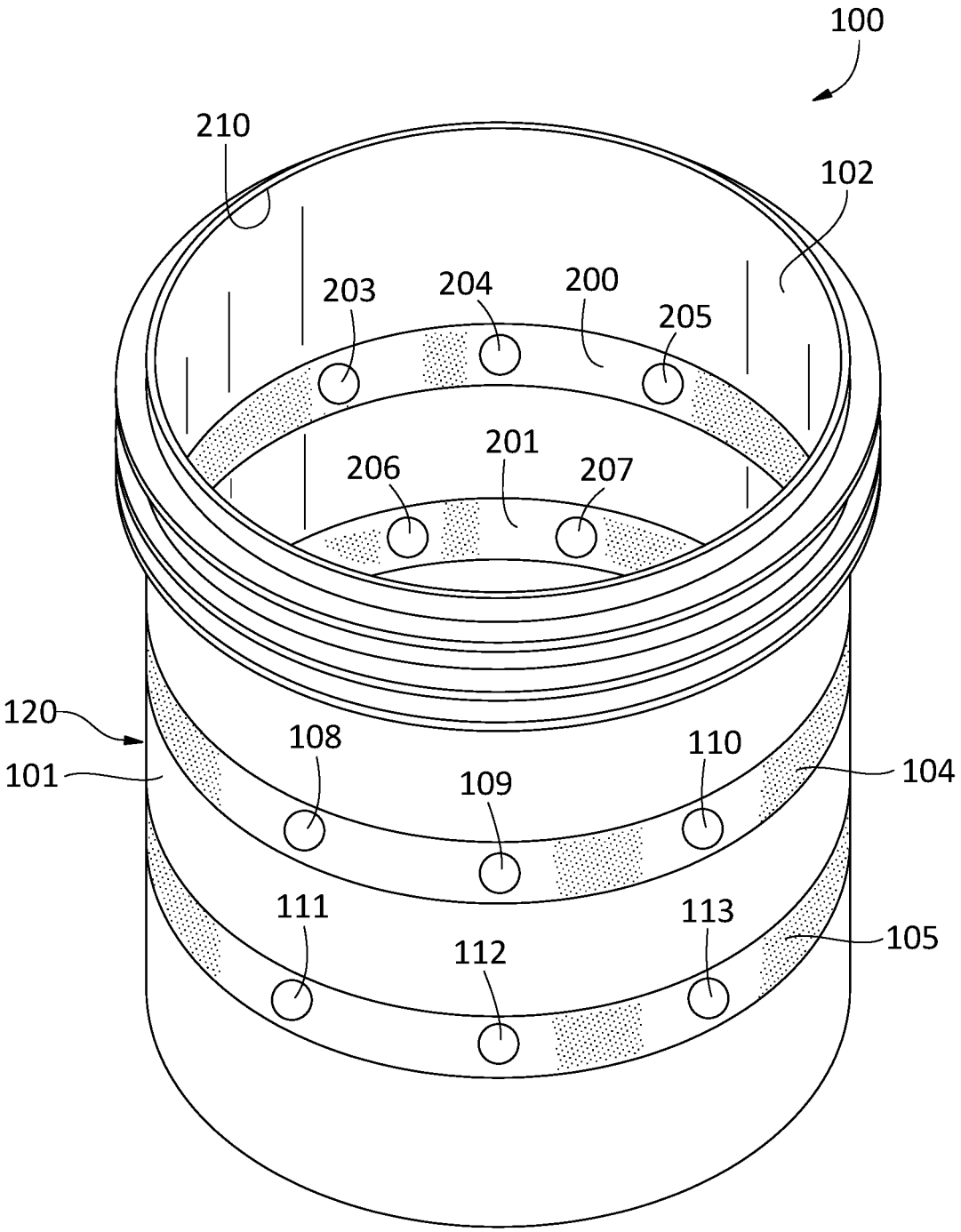
FIG. 2 is a top perspective view of the bucket such as is shown in FIG. 1 showing tools coupled thereto on the outside of the bucket.

FIG. 2 is a top perspective view of the bucket 100. The bucket 100 comprises a cylindrical receptacle 120 that has an opening 210. Objects may be placed in the receptacle 120 through the opening 210. The receptacle 120 has the outside surface 101 and the inside surface 102.

The outside of the bucket 100 comprises two metal bands 104 and 105, described above. Coupled to the metal bands 104 and 105 are magnets 108-113, respectively. As noted above, tools made of metal or tools with metal on them easily couple to the magnets 108-113. Therefore, the tools can be transported without the risk that the tools will be misplaced.

The inside surface 102 of the bucket 100 comprises at least one metal band 200. The metal band 200 is a circular metal band coupled to the receptacle's inside surface 102. The at least one inside circular metal band 200 laterally circles the inside surface 102 of the cylindrical receptacle 120.

The at least one inside metal band 200 may be coupled to the inside surface of the cylindrical receptacle 120 via epoxy. The inside metal band 200 may be coupled to the inside surface 102 of the receptacle 120 in other ways in other embodiments. Note that in other embodiments there may be more inside bands coupled to the inside surface 102 of the cylindrical receptacle 120, e.g., two bands or three bands.

One or more magnets 203-205 are magnetically coupled to the circumference of the at least one inside metal band 200. When there is a plurality of magnets 203-205 coupled to the inside metal band 200, the magnets 203-205 may be spaced apart along the inside metal band 200. In one embodiment, the magnets 203-205 coupled to the inside metal band are circular. The magnets can be other shapes in other embodiments.

The inside surface 102 of the bucket 100 comprises may comprise another metal band 201. The metal band 201 is a circular metal band coupled to the cylindrical receptacle's inside surface 102. The inside circular metal band 201 laterally circles the inside surface 102 of the cylindrical receptacle 120.

The metal band 201 may be coupled to the inside surface 102 of the cylindrical receptacle 120 via epoxy. The inside metal band 201 may be coupled to the inside surface of the receptacle in other ways in other embodiments. Note that in other embodiments there may be more inside bands coupled to the inside surface 102 of the cylindrical receptacle 120, e.g., two bands or three bands.

One or more magnets 206-207 are magnetically coupled to the circumference of the inside metal band 201. When there is a plurality of magnets 206-207 coupled to the inside metal band 201, the magnets 206-207 may be spaced apart along the inside metal band 201. In one embodiment, the magnets 206-207 coupled to the inside metal band 201 are circular. The magnets can be other shapes in other embodiments.

Figure 3:
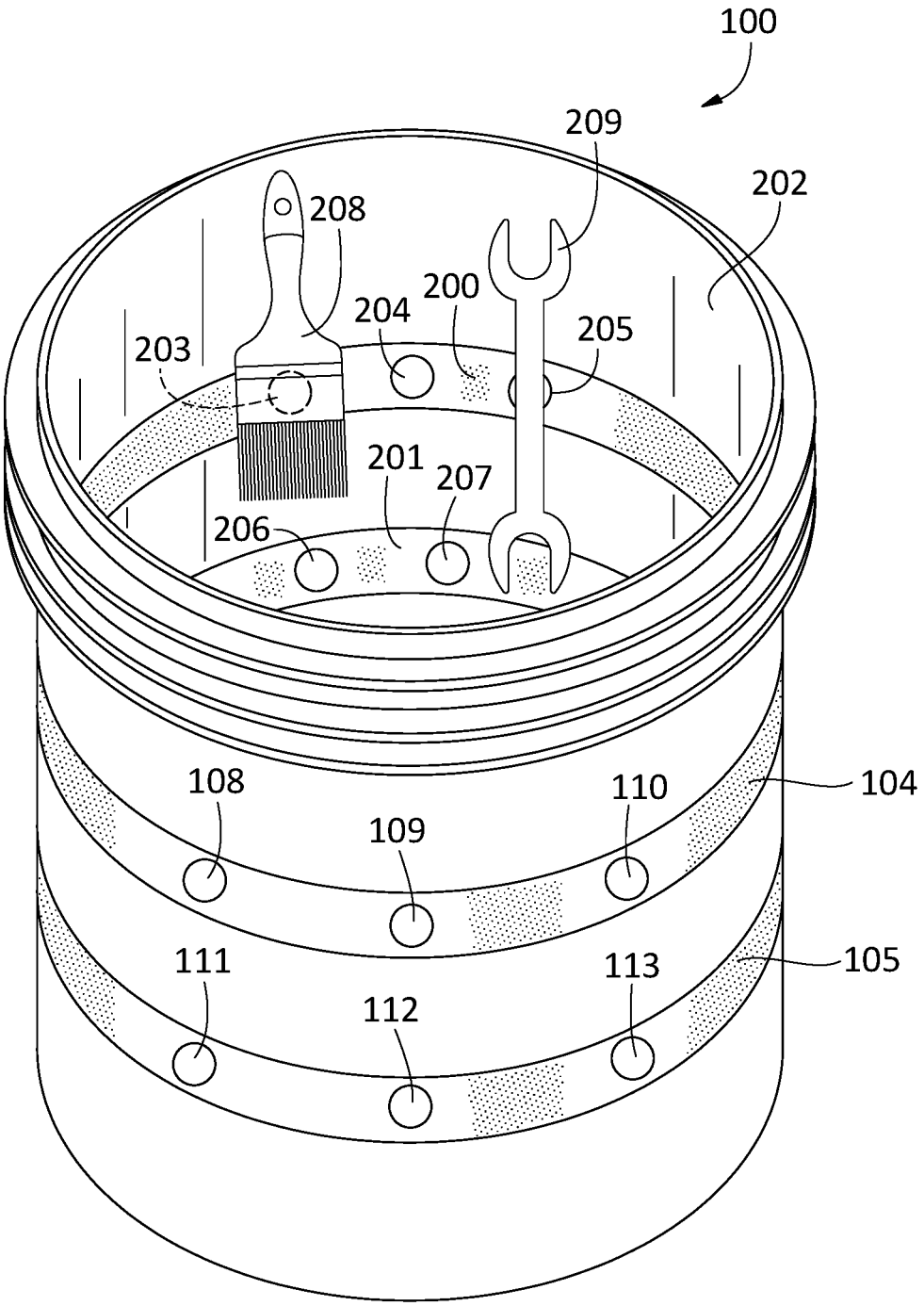
FIG. 3 is a top perspective view of the bucket such as is shown in FIG. 1 with tools coupled thereto on the inside of the bucket.

FIG. 3 is a top perspective view of the bucket 100. The top inside band 200 comprises the magnets 203-205. Metallic tools or tools with metal on them, for example a paint brush 208 and a wrench 209, easily couple to the magnets 203-205. Also, the bottom band comprises the magnets 206-207, and metallic tools or tools with metal on them couple to the magnets 206 and 207.

A user of the bucket 100 can carry tools with the bucket 100. In this regard, metal tools or tools with metal on them, e.g., wrench 208 and paint brush 209, couple to the magnets 203, 205, respectively. The user can carry the bucket 100 with the handle 103 with the tools coupled thereto without risk of losing his/her tools.

Figure 4:
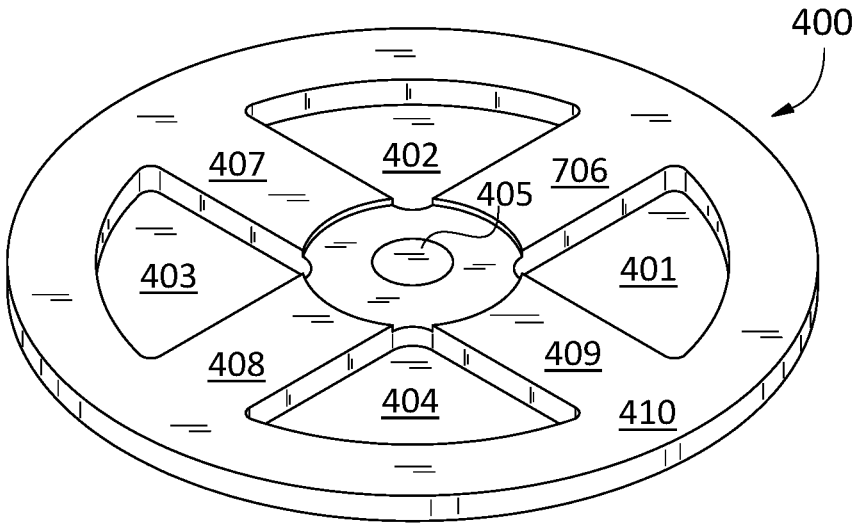
FIG. 4 is a top view of a lid for the bucket such as is shown in FIG. 1.

FIG. 4 is a lid 400 for placing on the bucket 100 (FIGS. 1-3) having a top surface 410. In one embodiment, the lid 400 screws onto the receptacle 120 (FIG. 1). The lid 400 may attach in other ways in other embodiments.

The bucket lid 400 comprises four rectangular protrusions 407, 408, 409, and 706 that cross in the center of the lid. The protrusions 407, 408, 409, and 705 may be used to turn the lid 400.

The protrusions 407, 408, 409, and 705 create triangular indentations 401-404 in the surface 410 of the lid 400. In one embodiment, the indentations 401-404 are lined with a magnetic material. When lined with a magnetic material, small metal objects like screws and nails may be placed in the indentations 401-404. The metal objects are retained by the magnetized indentations 401-404.

Figure 5:
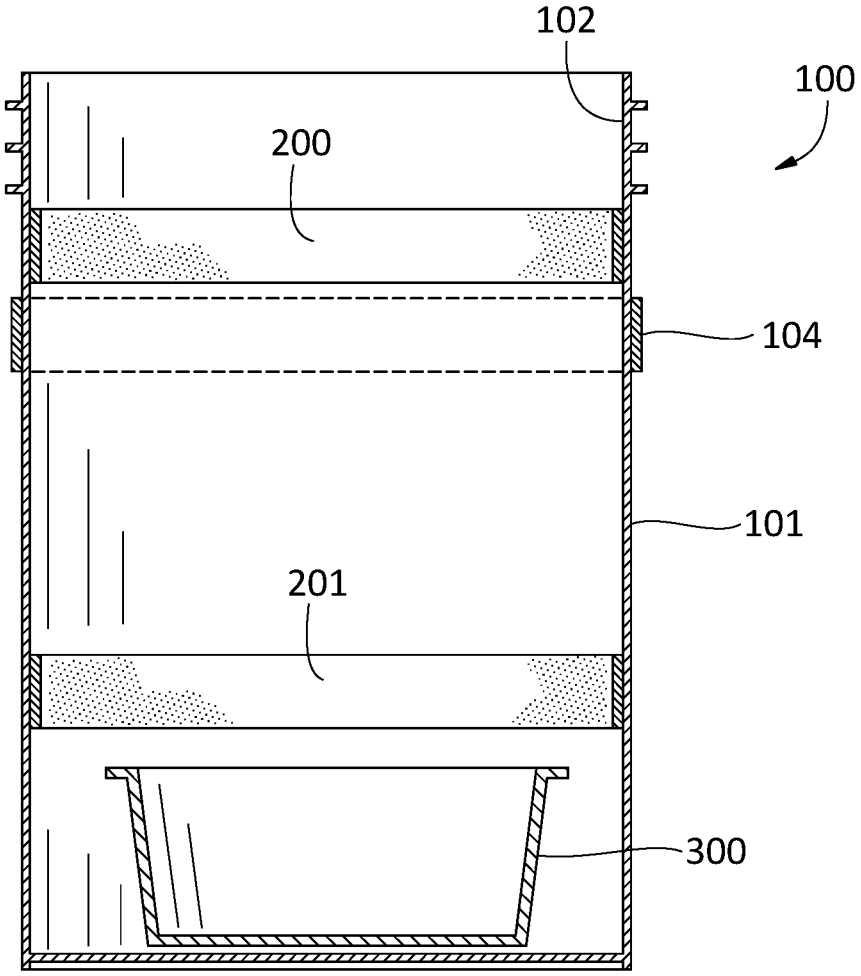
FIG. 5 is a cross-sectional view of the bucket such as is shown in FIG. 1.

FIG. 5 is a cross-sectional view of the bucket 100. The bucket 100 comprises the outside top metal band 104 on the outside surface 101. Further, the bucket 100 comprises the inside top band 200 on the inside surface 202 and the inside bottom band 201 on the inside surface 202.

In one embodiment, the bucket 100 comprises a basin 300. The basin 300 is made of magnetic material. Therefore, metal objects, e.g., screws and nails, may be dropped in the basin 300, and the metal objects magnetically couple to the basin 300. Thus, it is less likely that a user will lose the metal objects that are coupled to the basin 300.

The invention claimed is:

1. A device for carrying tools and sundries, comprising:

a receptacle having an outside surface and an inside surface;

at least one metal band coupled around the inside surface of the receptacle;

at least one magnet coupled to the metal band and configured for securing tools and metal objects.

2. The device for carrying tools and sundries as claimed in claim 1, further comprising a second metal band coupled below the one metal band and coupled around the inside surface of the receptacle.

3. The device for carrying tools and sundries as claimed in claim 2, further comprising a second magnet coupled to the second metal band for securing tools and metal objects.

4. The device for carrying tools and sundries as claimed in claim 3, further comprising a third metal band coupled around the outside surface of the receptacle.

5. The device for carrying tools and sundries as claimed in claim 4, further comprising a third magnet coupled to the third metal band for securing tools and metal objects.

6. The device for carrying tools and sundries as claimed in claim 5, further comprising a fourth metal band coupled below the third metal band and coupled around the outside surface of the receptacle.

7. The device for carrying tools and sundries as claimed in claim 6, further comprising a fourth magnet coupled to the fourth metal band for securing tool and metal objects.

8. A device for carrying tools and sundries, comprising:

a receptacle having an outside surface and an inside surface;

at least one metal band coupled around the outside surface of the receptacle;

at least one magnet coupled to the metal band and configured for securing tools and metal objects.

9. The device for carrying tools and sundries as claimed in claim 8, further comprising a second metal band coupled below the one metal band and coupled around the outside surface of the receptacle.

10. The device for carrying tools and sundries as claimed in claim 9, further comprising a second magnet coupled to the second metal band for securing tools and metal objects.

11. The device for carrying tools and sundries as claimed in claim 10, further comprising a third metal band coupled around the inside surface of the receptacle.

12. The device for carrying tools and sundries as claimed in claim 11, further comprising a third magnet coupled to the third metal band for securing tools and metal objects.

13. The device for carrying tools and sundries as claimed in claim 12, further comprising a fourth metal band coupled below the third metal band and coupled around the inside surface of the receptacle.

14. The device for carrying tools and sundries as claimed in claim 13, further comprising a fourth magnet coupled to the fourth metal band for securing tools and metal objects.

15. The device for carrying tools and sundries of claim 8, further comprising a handle for carrying the receptacle.

16. The device for carrying tools and sundries as claimed in claim 8, further comprising a magnetic basin coupled to a bottom of the bucket for securing metal objects.

17. The device for carrying tools and sundries as claimed in claim 8, further comprising a lid that couples to a top of the receptacle.

18. The device for carrying tools and sundries as claimed in claim 17, wherein the lid comprises indentations and the indentations are lined with magnetic material for holding metal objects.

* * * * *